US006733281B1

(12) United States Patent
Stoner

(10) Patent No.: US 6,733,281 B1
(45) Date of Patent: May 11, 2004

(54) HEATING FUEL CANISTER

(75) Inventor: Daniel P. Stoner, Yorba Linda, CA (US)

(73) Assignee: STO Corporation, Riverside, CA (US)

( * ) Notice: Subject to any disclaimer, the term of this patent is extended or adjusted under 35 U.S.C. 154(b) by 0 days.

(21) Appl. No.: 10/331,170

(22) Filed: Dec. 27, 2002

(51) Int. Cl.[7] ..... F23D 3/24
(52) U.S. Cl. ..... 431/323; 431/321; 126/45
(58) Field of Search ..... 431/320, 321, 431/322, 323, 324, 298; 126/96, 45

(56) References Cited

U.S. PATENT DOCUMENTS

| | | | | |
|---|---|---|---|---|
| 4,604,053 A | | 8/1986 | de la Rosa | |
| 4,725,225 A | | 2/1988 | Gravitt | |
| 4,781,577 A | * | 11/1988 | Stewart | 431/320 |
| 4,850,858 A | | 7/1989 | Blankenship | |
| 5,193,521 A | * | 3/1993 | Levinson et al. | 431/320 |
| 5,405,262 A | | 4/1995 | Appel | |
| 5,520,536 A | * | 5/1996 | Rodgers et al. | 431/329 |
| 5,529,485 A | | 6/1996 | D'Ambro et al. | |
| 5,829,966 A | | 11/1998 | Stoner | |
| 5,904,476 A | | 5/1999 | Hoffman | |
| 5,927,269 A | | 7/1999 | Quarrie | |
| 6,312,251 B1 | | 11/2001 | Schmorleitz | |
| 6,371,756 B1 | | 4/2002 | Toohey | |
| 6,579,090 B1 | * | 6/2003 | Taubitz et al. | 431/320 |

FOREIGN PATENT DOCUMENTS

FR 2773 870 A1 * 7/1999 ..... F23D/3/24

* cited by examiner

*Primary Examiner*—Josiah Cocks
(74) *Attorney, Agent, or Firm*—John S. Christopher

(57) ABSTRACT

A heating fuel canister typically used for heating food in a buffet line includes a housing for containing a volume of liquid fuel, the housing having a continuous cylindrical sidewall and a bottom wall. An interseal top surface is affixed to a top edge of the cylindrical sidewall and includes a threaded neck having a center penetration formed there through. The threaded neck is integral with the interseal top surface. A pan-shaped disk is press-fitted into the center penetration of the threaded neck. A fiberglass layer is positioned upon the pan-shaped disk. Finally, a fiberglass wick is extended from within the housing and is passed through the pan-shaped disk and the fiberglass layer for drawing liquid fuel into the fiberglass wick and the fiberglass layer for providing a broad, hot uniform flame when ignited.

12 Claims, 2 Drawing Sheets

HEATING FUEL CANISTER

BACKGROUND OF THE INVENTION

1. Technical Field

The present invention relates to fuel canisters. More specifically, the present invention relates to methods and apparatus for a heating fuel canister for use in heating food in a buffet line and having a fiberglass wick combined with a fiberglass layer, each drawing liquid fuel from within a housing for providing a broad, uniform flame when the liquid fuel is ignited.

2. Background Art

The prior art is directed to methods and apparatus for liquid fuel containers for use in heating food in a buffet line.

Many restaurants, hotels, and convention centers typically offer dining to patrons in the form of a buffet line. The buffet line type of dining experience is popular with patrons since it offers them the opportunity to pick and choose from a variety of prepared foods for a fee. Once the foods are prepared, they typically are displayed in a buffet line where patrons pass by and select which foods they wish to consume.

The buffet line is typically a series of tables in tandem on which the prepared foods are set out in containers known as chafing dishes. The chafing dishes are each typically mounted in a metal frame which is positioned on the series of tables. Ideally, the food is initially set out at the proper temperature for consumption and that proper temperature must be maintained. Those foods intended to be consumed at an elevated temperature must be kept hot during the time frame that the food is being displayed. In order to maintain the elevated temperature of the food, metallic fuel containers comprising a volume of liquid fuel such as, for example, diethylene glycol (or an equivalent) in combination with a suitable means for drawing the fuel from the fuel container (i.e., fuel drawing means) have been utilized. The fuel drawing means causes the fuel to be drawn out of the metallic fuel container via capillary action so that the fuel can be ignited. Once ignited, the fuel burns producing a flame which can be placed underneath the individual chafing dishes mounted within the metal frames. The flame transfers heat to the bottom of the individual chafing dishes for keeping the food contained therein hot.

Liquid fuel containers of the prior art are typically comprised of metal, such as, for example, light gauge steel. The typical prior art fuel container is cylindrical in shape and has a bottom wall and a top surface including an opening for providing access to the liquid fuel. Each of the prior art fuel containers includes a fuel drawing means for drawing the liquid fuel out of the fuel container for being ignited. Typically, the fuel drawing means is comprised of a single piece of non-flammable material which is employed to draw the liquid fuel out of the fuel container via capillary action for combustion. A cap or cover is known for sealing the fuel container during initial shipment and shelf life, and for safe storage after the fuel container has been opened but before all of the liquid fuel has been exhausted.

In order for the fuel container to operate efficiently and maintain the food temperature within an acceptable range, it is desirable that the fuel drawing means be easily ignited and produce a hot flame. Unfortunately, this criteria is not satisfied by the fuel containers of the prior art. Certain types of fuel drawing means are more convenient to ignite and generate a more concentrated flame but do not produce a flame sufficiently hot to maintain the food at the desired temperature. Other types of fuel drawing means generate a broader, i.e., less concentrated, flame but are very difficult to ignite. Thus, the ideal features of a fuel drawing means which include easy ignition and production of a hot flame have evaded designers of liquid fuel containers of the prior art.

Thus, there is a need in the art for a heating fuel canister having a housing including a continuous cylindrical sidewall, a bottom wall, a corrugated interseal top surface including a threaded neck integral therewith, a pan-shaped disk, and a combination of a fiberglass layer in physical communication with a fiberglass wick, the fiberglass layer and the fiberglass wick each drawing liquid fuel from the fuel canister for providing a broad, hot uniform flame when ignited, ignition being easily accomplished.

DISCLOSURE OF THE INVENTION

Briefly, and in general terms, the present invention provides a new and improved heating fuel canister for use in heating food in a buffet line in, for example, a restaurant, convention center or hotel. The heating fuel canister is employed by positioning it underneath a chafing dish mounted in a metal frame so that the chafing dish is suspended above the buffet line table. The heating fuel-canister contains a supply of liquid fuel that once ignited produces a broad, hot uniform flame for heating the food within the chafing dish.

In a preferred embodiment, the heating fuel canister can be comprised of a housing fashioned from a suitable steel material and having a continuous cylindrical sidewall and a bottom wall. The housing is covered by an interseal top surface which is affixed to a top edge of the cylindrical sidewall by a metal seam. The steel material of the interseal top surface is corrugated to increase the strength thereof and further includes a threaded neck having a center penetration formed there through. The threaded neck is integral with the corrugated interseal top surface (i.e., the threaded neck and the interseal top surface are comprised of one drawn piece of steel material) and is utilized to fill the heating fuel canister with a volume of liquid fuel.

Press-fitted within the center penetration of the threaded neck is a pan-shaped disk having an aperture and an air hole formed there through. Positioned upon the pan-shaped disk is a flat fiberglass layer or pad wherein the fiberglass layer is circular in shape and further includes a small circular opening. The small circular opening in the fiberglass layer is positioned to align with the aperture formed in the pan-shaped disk. Additionally, a fiberglass wick comprised of multiple strands of fiberglass extends from within the housing and upward through the aperture in the pan-shaped disk and the small circular opening in the fiberglass layer. Thus, the fiberglass wick is in physical contact with the fiberglass layer.

When assembled, the fiberglass wick of the heating fuel canister is immersed within the volume of liquid fuel contained within the housing. The liquid fuel is drawn up through and saturates the fiberglass wick via capillary action as is known in the art. The liquid fuel is also distributed to and saturates the fiberglass layer since the fiberglass wick is in physical communication with the fiberglass layer. Consequently, when ignited, the liquid fuel resident within both the fiberglass wick and the fiberglass layer burns resulting in a broader, hotter, more uniform flame than that produced in fuel containers of the prior art. This inventive combination results in a heating fuel canister having the desirable features of generating more heat (i.e., flame burns hotter) and being easier to ignite. Additionally, the heating fuel canister includes a threaded cap that cooperates with the threaded neck for removably sealing the center penetration of the corrugated interseal top surface.

The present invention is generally directed to a heating fuel canister having a combination of a fiberglass layer in physical communication with a fiberglass wick, the fiberglass layer and fiberglass wick each drawing liquid fuel from the fuel canister for providing a broad, hot uniform flame when ignited, ignition being easily accomplished. This combination provides the ideal features of a heating fuel canister which include convenient ignition and production of a hot flame. In its most fundamental embodiment, the heating fuel canister includes a housing for containing a volume of liquid fuel, the housing having a continuous cylindrical sidewall and a bottom wall. An interseal top surface is affixed to a top edge of the cylindrical sidewall and includes a threaded neck having a center penetration formed there through. The threaded neck is integral with the interseal top surface. A pan-shaped disk is press-fitted into the center penetration of the threaded neck. A fiberglass layer is positioned upon the pan-shaped disk. Finally, a fiberglass wick is extended from within the housing and is passed through the pan-shaped disk and the fiberglass layer for drawing liquid fuel into the fiberglass wick and the fiberglass layer for providing a broad, hot uniform flame when ignited.

These and other objects and advantages of the present invention will become apparent from the following more detailed description, taken in conjunction with the accompanying drawings which illustrate the invention, by way of example.

DETAILED DESCRIPTION OF THE INVENTION

Figure 1:
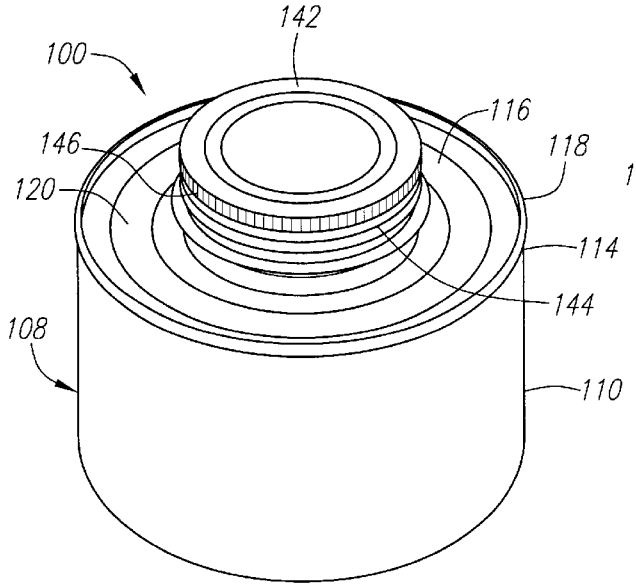
FIG. 1 is a perspective view of a heating fuel canister of the present invention showing a housing having a continuous cylindrical sidewall with a corrugated interseal top surface affixed to the sidewall, and further showing a threaded cap.

The present invention is a heating fuel canister 100 which employs a fiberglass layer or pad 102 in combination with a fiberglass wick 104 for increasing the surface area that draws a liquid fuel 106 contained within a housing 108. Thus, when ignited, the liquid fuel 106 resident within both the fiberglass wick 104 and the fiberglass layer 102 burns generating a broader, hotter, more uniform flame than that produced in the prior art. This inventive combination results in a heating fuel canister having the desirable features of generating more heat and being easier to ignite. A preferred embodiment of the heating fuel canister 100 is illustrated in FIGS. 1–6 and is typically employed in a buffet line (not shown) for heating food in a chafing dish (not shown) during the serving period in a restaurant, convention center or hotel.

In the preferred embodiment, the heating fuel canister 100 can be comprised of, for example, the housing 108 typically fashioned from steel material or other suitable metal. The housing 108 includes a continuous, cylindrical sidewall 110 shown best in FIGS. 1 and 2 and a bottom wall 112 shown best in FIG. 6. The recitation of a continuous, cylindrical sidewall 110 is intended to imply a circular structure wherein the bottom wall 112 is continuous with the cylindrical sidewall 110 as is clearly shown in the cross-sectional view of FIG. 5. Thus, the cylindrical sidewall 110 and the bottom wall 112 are formed from the same drawn sheet of steel material. The cylindrical sidewall 110 further includes a top edge 114 as is clearly shown in FIG. 5.

The housing 108 is covered by an interseal top surface 116 which is affixed as by press-fitting to the top edge 114 of the cylindrical sidewall 110 by a metal seam 118 clearly shown in FIGS. 1–5. The interseal top surface 116 is also fashioned from steel material and in combination with the cylindrical sidewall 110 and the bottom wall 112 form an enclosure for containing the volume of liquid fuel 106 which can be, for example, diethylene glycol or an equivalent. The steel material of the interseal top surface 116 is corrugated, i.e., shaped to have alternating ridges or grooves forming a corrugation(s) 120. The corrugations 120 formed in the interseal top surface 116 are intended to increase the strength of the interseal top surface 116 and thus the structural integrity of the heating fuel canister 100.

The heating fuel canister 100 also includes a threaded neck 122 having a center penetration 124 formed there through. The threaded neck 122 is integral with the corrugated interseal top surface 116, i.e., the threaded neck 122 and the corrugated interseal top surface 116 are comprised of one drawn piece of steel material as is clearly shown in FIG. 2 and the cross-sectional view of FIG. 5. A plurality of threads 126 form the neck 122 as is clearly shown in FIG. 2. The threaded neck 122 and the center penetration 124 are employed for inserting the volume of liquid fuel 106 into the heating fuel canister 100. Likewise, the threaded neck 122 and the center penetration 124 are utilized to draw liquid fuel 106 out of the heating fuel canister 100 as will be explained in more detail as set forth herein below.

Figure 2:
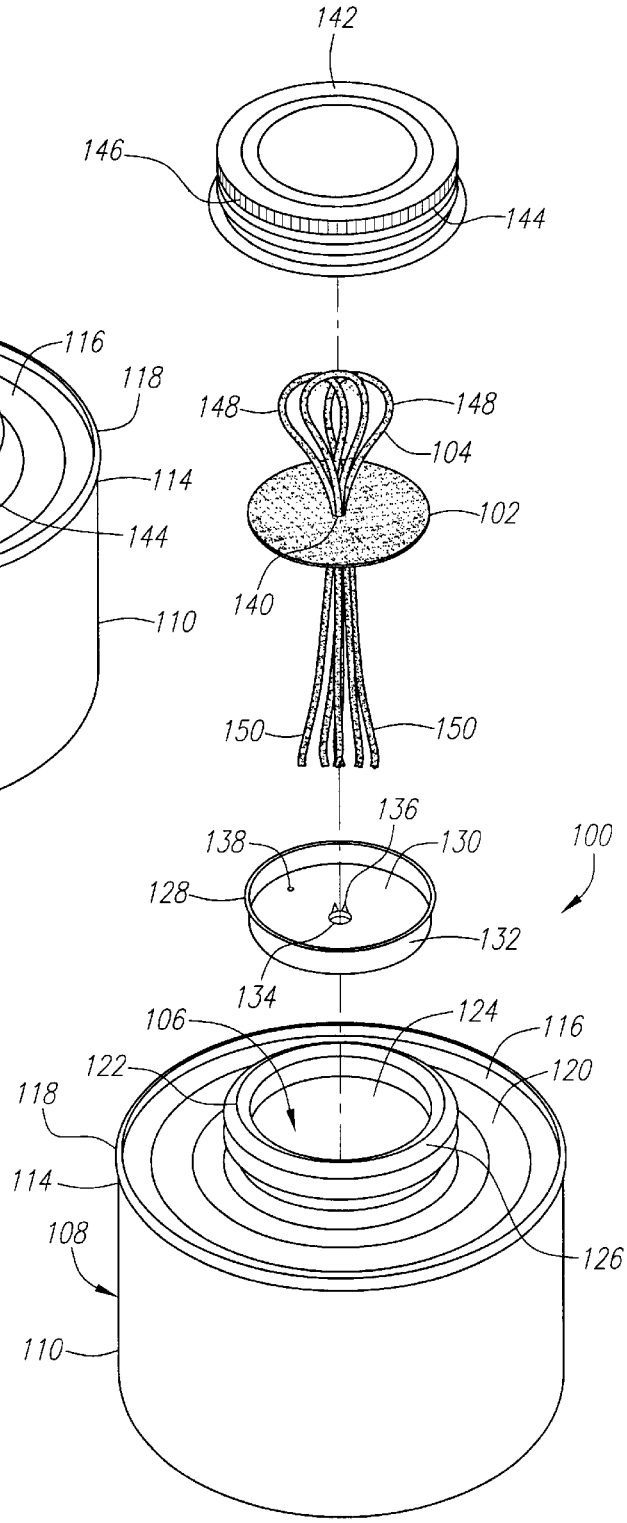
FIG. 2 is an exploded view of the heating fuel canister of FIG. 1 showing he continuous cylindrical sidewall of the housing, the corrugated interseal top surface including a threaded neck integral with the interseal top surface, a pan-shaped disk, a fiberglass wick extending through a fiberglass layer, and the threaded cap.
Figure 3:
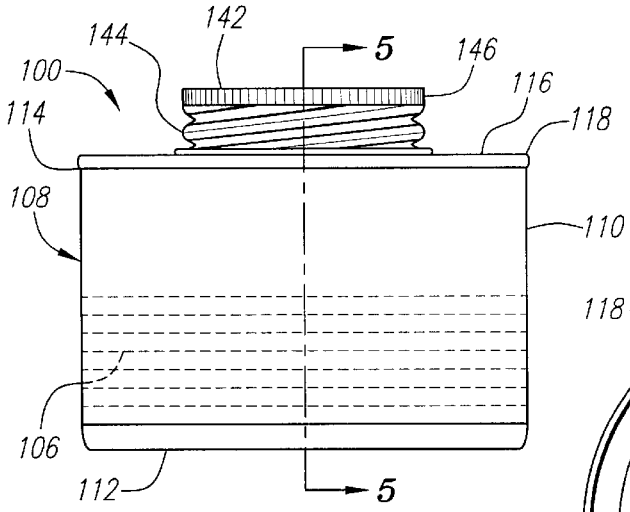
FIG. 3 is a frontal elevation of the heating fuel canister of FIG. 1 showing the continuous cylindrical sidewall of the housing, a bottom wall, and the threaded cap.
Figure 4:
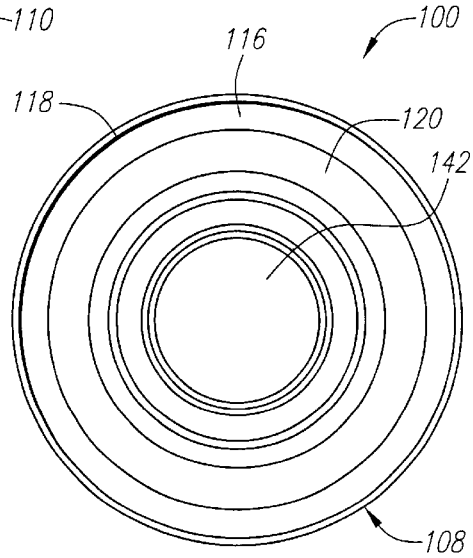
FIG. 4 is a top plan view of the heating fuel canister of FIG. 1 showing the corrugated interseal top surface and the threaded cap.
Figure 5:
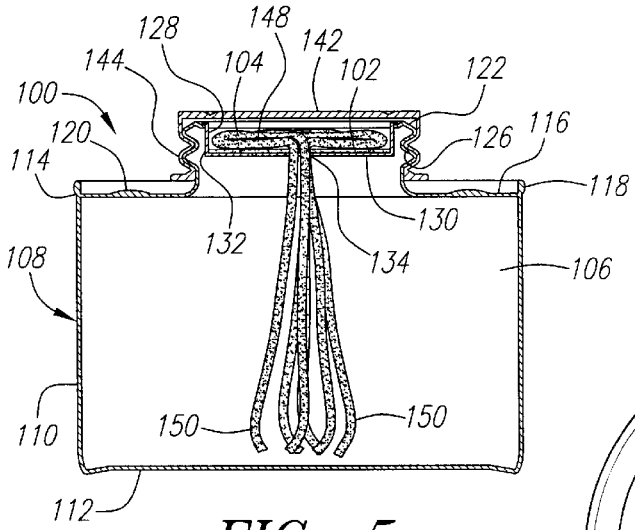
FIG. 5 is a cross-sectional view of the heating fuel canister of FIG. 1 taken along the line 5—5 of FIG. 3 showing the bottom wall, continuous cylindrical sidewall, corrugated interseal top surface integral with the threaded neck, pan-shaped disk supporting the fiberglass layer with the fiberglass wick extending there through, and the threaded cap.
Figure 6:
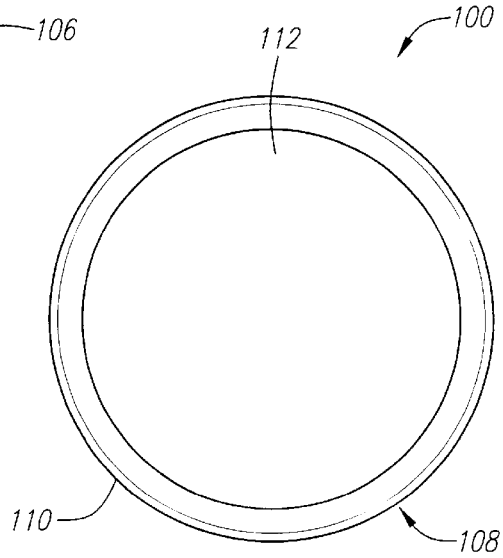
FIG. 6 is a bottom plan view of the heating fuel canister of FIG. 1 showing the bottom wall of the housing.

Press-fitted within the center penetration 124 of the threaded neck 122 is a pan-shaped disk 128 as is best shown in the exploded view of FIG. 2. The pan-shaped disk 128 is typically comprised of steel material and includes a flat bottom portion 130 and a continuous, upright circular portion 132 typically orthogonal to the flat bottom portion 130. An aperture 134 is formed generally at the center of the flat bottom portion 130 and can include a jagged edge 136 to assist in holding the fiberglass wick 104 in position as is shown in FIG. 5. An air hole 138 is also formed through the flat bottom portion 130 of the pan-shaped disk 128 for enabling air to flow into the housing 108 as the liquid fuel 106 is withdrawn and consumed. Positioned flat upon the flat bottom portion 130 of the pan-shaped disk 128 is the flat fiberglass layer or pad 102 shown exploded away in FIG. 2 and shown in position on the flat bottom portion 130 of the pan-shaped disk 128 in FIG. 5. The fiberglass layer 102 is typically circular in shape to fit the configuration of the pan-shaped disk 128 and exhibits a very narrow depth of only a fraction of a centimeter as is illustrated in FIG. 2.

A small circular opening 140 is formed at approximately the center of the fiberglass layer 102 and is aligned with the aperture 134 formed within the flat bottom portion 130 of the pan-shaped disk 128. This construction enables the fiberglass wick 104 to extend from the liquid fuel 106 contained within the housing 108 and upward through the aperture 134 and the small circular opening 140 formed in the fiberglass layer 102. Thus, the fiberglass layer 102 and the fiberglass wick 104 are in physical communication, i.e., physical contact, and further each is non-flammable. Although the fiberglass layer 102 exhibits a thin layer, pancake-shape, the fiberglass wick 104 is comprised of multiple fiberglass strands which extend upward above the fiberglass layer 102 as is shown in FIG. 2.

It is also noted that the heating fuel canister 100 further includes a threaded cap 142 fashioned from a single piece of steel material. The threaded cap 142 includes a plurality of threads 144 that correspond to and cooperate with the plurality of threads 126 of the threaded neck 122. Additionally, a plurality of indentations 146 are formed directly above the threads 144 for enabling the threaded cap 142 to be more easily grasped. The threaded cap 142 is employed for removably sealing the center penetration 124 of the corrugated interseal top surface 116 when the heating fuel canister 100 is not in use. The threaded cap 142 can include a washer or seal (not shown) mounted directly on the bottom side of the cap 142 for interfacing with the top of the threaded neck 122 when assembled. This design provides a leakproof construction for eliminating leakage of the liquid fuel 106 if the heating fuel canister 100 is inadvertently overturned.

When assembled, the fiberglass wick 104 of the heating fuel canister 100 is immersed within the volume of liquid fuel 106 contained within the housing 108. Each fiberglass strand that forms the fiberglass wick 104 is shaped, for example, to provide a loop 148 with a pair of corresponding loose ends 150 as shown in FIGS. 2 and 5. It is the loose ends 150 that are actually immersed in the volume of liquid fuel 106. The liquid fuel 106 is drawn up through the loose ends 150 and saturates each loop 148 that forms the fiberglass wick 104 via capillary action as is well known in the art. The liquid fuel 106 is also distributed to and saturates the fiberglass layer 102 since the fiberglass wick 104 is in physical communication, i.e., physical contact, with the fiberglass layer 102. This occurs since both the wick 104 and the layer 102 are comprised of porous, non-flammable fiberglass and the liquid fuel 106 travels between them. Consequently, when ignited, the liquid fuel 106 resident within both the fiberglass wick 104 and the fiberglass layer 102 burns resulting in a broader, hotter, more uniform flame than that produced by fuel containers of the prior art.

This inventive combination results in the heating fuel canister 100 having the desirable features of generating more heat (i.e., flame burns hotter) and being easier to ignite which are problems experienced by the prior art fuel containers. The liquid fuel 106 is drawn upward along the loose ends 150 of the fiberglass wick 104 from within the housing 108 and then distributed to the loops 148 of the fiberglass wick 104 and to the fiberglass layer 102. Consequently, when ignited, the liquid fuel 106 resident in both the fiberglass wick 104 and the fiberglass layer 102 burns simultaneously. This extended base caused by surrounding the fiberglass wick 104 with the fiberglass layer 102 provides a broader flame base. Since more liquid fuel 106 is available in the joined fiberglass wick 104 and fiberglass layer 102, the fuel 106 is easier to ignite and produces a hotter, i.e., higher temperature, flame due to increased heat and fuel 106. Further, because of the two local sources of liquid fuel 106 (i.e., fuel in both the fiberglass wick 104 and the fiberglass layer 102), the flame generated is more uniform and will burn more consistently. Thus, the flame generated by the present invention is less likely to be inadvertently extinguished.

Thus, the present invention is generally directed to a heating fuel canister 100 having the combination of the fiberglass layer 102 in physical communication with the fiberglass wick 104 where the fiber wick 104 and the fiberglass layer 102 each draw liquid fuel 106 from within the housing 108. This inventive design provides the broader, hotter, more consistently uniform flame when ignited, ignition being easily accomplished compared with other prior art fuel containers. This inventive combination provides the ideal features of the heating fuel canister 100 which exhibits convenient ignition resulting in the production of a hotter flame because of the two paths available for transmission of the liquid fuel 106. It is further noted that the inside surface of the steel material used to form the housing 108, if desired, can be coated with a suitable material to prevent damage from occurring to the steel material as a result of exposure to the liquid fuel 106 contained within the housing 108. Additionally, the heating fuel canister 100 is disposable, however, the steel material from which the canister 100 is fashioned is recyclable.

In summary, the most fundamental embodiment of the heating fuel canister 100 comprises the housing 108 for containing the volume of liquid fuel 106 such as, for example, diethylene glycol, and where the housing 108 includes the continuous cylindrical sidewall 110 and the bottom wall 112. The interseal top surface 116 is affixed to the top edge 114 of the cylindrical sidewall 110 and includes the threaded neck 122 having the center penetration 124 formed there through. The threaded neck 122 is integral with the interseal top surface 116. The pan-shaped disk 128 is press-fitted into the center penetration 124 of the threaded neck 122. The fiberglass layer 102 is positioned upon the pan-shaped disk 128. Finally, the fiberglass wick 104 is extended from within the housing 108 and is passed through the pan-shaped disk 128 and the fiberglass layer 102 for drawing liquid fuel 106 into the fiberglass wick 104 and the fiberglass layer 102 for providing the broad, hot uniform and consistent flame when ignited. The heating fuel canister 100 is then positioned underneath a chafing dish (not shown) which is typically mounted in a metal frame (not shown) so that the chafing dish is suspended above a buffet line table.

The present invention provides novel advantages over other fuel containers known in the prior art. A main advantage of the fuel canister 100 is that it includes the fiberglass wick 104 in combination with (i.e., in physical contact with) the fiberglass layer 102. Thus, the liquid fuel 106 drawn up into the fiberglass wick 104 through the loose ends 150 will saturate both the plurality of loops 148 of the fiberglass wick 104 in addition to the fiberglass layer 102. Thus, the present invention provides two paths for fuel delivery where the additional fuel enables quicker ignition of the heating fuel canister 100. Further, the fiberglass wick 104 sharing the liquid fuel 106 with the fiberglass layer 102 provides a broader base for the flame ignition. The additional fuel results in a flame that burns hotter to keep food warm in a chaffing dish over a longer period of time. Finally, the fiberglass wick 104 in combination with the fiberglass layer 102 provides a more consistent flame which is less likely to be inadvertently extinguished.

While the present invention is described herein with reference to illustrative embodiments for particular applications, it should be understood that the invention is not limited thereto. Those having ordinary skill in the art and access to the teachings provided herein will recognize additional modifications, applications and embodiments within the scope thereof and additional fields in which the present invention would be of significant utility.

It is therefore intended by the appended claims to cover any and all such modifications, applications and embodiments within the scope of the present invention.

Accordingly,

What is claimed is:

1. A heating fuel canister comprising:

a housing for containing a volume of liquid fuel, said housing having a continuous cylindrical sidewall and a bottom wall;

an interseal top surface affixed to a top edge of said cylindrical sidewall and including a threaded neck having a center penetration formed there through, said threaded neck being integral with said interseal top surface;

a pan-shaped disk press-fitted into said center penetration of said threaded neck;

a fiberglass layer positioned upon a flat bottom portion of said pan-shaped disk; and a fiberglass wick extending from within said housing and passing through and in physical contact with said pan-shaped disk and said fiberglass layer, said liquid fuel being drawn into said fiberglass wick and said fiberglass layer for providing a broad, hot uniform flame when ignited.

2. The heating fuel canister of claim 1 wherein said interseal top surface is corrugated for increasing the strength of said top surface.

3. The heating fuel canister of claim 1 wherein said threaded neck and said interseal top surface are comprised of one drawn piece of steel.

4. The heating fuel canister of claim 1 wherein said pan-shaped disk further includes an air hole.

5. The heating fuel canister of claim 1 wherein said fiberglass layer further includes a small opening for accommodating the passage of said fiberglass wick.

6. The heating fuel canister of claim 5 wherein said small opening formed within said fiberglass layer is positioned to align with an aperture formed within said pan-shaped disk for facilitating the passage of said fiberglass wick.

7. The heating fuel canister of claim 1 further including a threaded cap for cooperating with said threaded neck and for removably sealing said center penetration.

8. The heating fuel canister of claim 1 wherein said interseal top surface is affixed to said top edge of said continuous cylindrical sidewall with a seam.

9. A heating fuel canister comprising:

a housing for containing a volume of liquid fuel, said housing having a continuous cylindrical sidewall and a bottom wall;

a corrugated interseal top surface affixed to a top edge of said cylindrical sidewall and including a threaded neck having a center penetration formed there through, said threaded neck being integral with said interseal top surface;

a pan-shaped disk having an aperture formed there through and being press-fitted into said center penetration of said threaded neck;

a flat fiberglass layer positioned upon a flat bottom portion of said pan-shaped disk; and a fiberglass wick extending from within said housing and passing through and in physical contact with said pan-shaped disk and said fiberglass layer, said liquid fuel being drawn into said fiberglass wick and said fiberglass layer for providing a broad, hot uniform flame when ignited.

10. The heating fuel canister of claim 9 further including a threaded cap for cooperating with said threaded neck and for removably sealing said center penetration.

11. A heating fuel canister for use in heating food comprising:

a housing for containing a volume of liquid fuel, said housing having a continuous cylindrical sidewall and a bottom wall;

a corrugated interseal top surface affixed to a top edge of said cylindrical sidewall and including a threaded neck having a center penetration formed there through, said threaded neck being integral with said corrugated interseal top surface;

a pan-shaped disk having an aperture and an air hole formed there through and being press-fitted into said center penetration of said threaded neck;

a flat fiberglass layer having a small opening formed there through and positioned flat upon a flat bottom portion of said pan-shaped disk; and a fiberglass wick extending from within said housing and passing through and in physical contact with said aperture of said pan-shaped disk and said small opening of said fiberglass layer, said liquid fuel being drawn into said fiberglass wick and said fiberglass layer for providing a broad, hot uniform flame when ignited.

12. The heating fuel canister of claim 11 further including a threaded cap for cooperating with said threaded neck and for removably sealing said center penetration.

* * * * *